US008826781B2

(12) United States Patent
Chen

(10) Patent No.: US 8,826,781 B2
(45) Date of Patent: Sep. 9, 2014

(54) SCREWDRIVER HAVING A REMOVABLE ROD MEMBER

(75) Inventor: Tsai-Ching Chen, Changhua (TW)

(73) Assignee: Good Year Hardware Co., Ltd., Changhua (TW)

( * ) Notice: Subject to any disclaimer, the term of this patent is extended or adjusted under 35 U.S.C. 154(b) by 414 days.

(21) Appl. No.: 13/355,160

(22) Filed: Jan. 20, 2012

(65) Prior Publication Data

US 2012/0285299 A1 Nov. 15, 2012

(30) Foreign Application Priority Data

May 9, 2011 (TW) ..... 100116181 A

(51) Int. Cl.

| | |
|---|---|
| ***B25B 23/16*** | (2006.01) |
| ***B25B 15/00*** | (2006.01) |
| ***B25G 1/04*** | (2006.01) |
| ***B25G 3/18*** | (2006.01) |
| ***B25B 15/02*** | (2006.01) |

(52) U.S. Cl.

CPC ..... *B25B 15/001* (2013.01); *B25G 1/043* (2013.01); *B25G 3/18* (2013.01); *B25B 15/02* (2013.01); *Y10S 279/906* (2013.01)

USPC ..... 81/177.2; 81/438; 279/906; 279/75

(58) Field of Classification Search

USPC ..... 81/177.2, 438, 439, 177.6; 279/80, 75, 279/906, 79, 905, 30; 192/43.2

See application file for complete search history.

(56) References Cited

U.S. PATENT DOCUMENTS

| | | | | |
|---|---|---|---|---|
| 5,687,820 | A * | 11/1997 | Lin | 192/43.2 |
| 5,732,606 | A * | 3/1998 | Chiang | 81/177.2 |
| 6,044,733 | A * | 4/2000 | Liu | 81/177.6 |
| 7,287,449 | B2 * | 10/2007 | Abel et al. | 81/177.2 |

FOREIGN PATENT DOCUMENTS

| | | |
|---|---|---|
| TW | 201107093 | 3/2011 |

* cited by examiner

*Primary Examiner* — Monica Carter
*Assistant Examiner* — Melanie Alexander
(74) *Attorney, Agent, or Firm* — Muncy, Geissler, Olds & Lowe, P.C.

(57) ABSTRACT

A screwdriver includes a grip defining an accommodation chamber, an inner tube with interference holes mounted in the accommodation chamber, a rod member movable in and out of the inner tube and having interference grooves corresponding to the interference holes and a neck and carrying a latching member, an operating device set, which includes an operating member rotatably mounted at the front side of the grip, interference members and an actuation member having a pressure wall for holding down the interference members, a first elastic member, a ring cap having an axial hole and a stop wall around the axial hole for stopping the latching member, and a second elastic member. Thus, the screwdriver is operable by rotating the operating member and effectively prevents the rod member from being ejected out of the grip.

11 Claims, 7 Drawing Sheets

SCREWDRIVER HAVING A REMOVABLE ROD MEMBER

BACKGROUND OF THE INVENTION

1. Field of the Invention

The present invention relates to a tool for driving screws and more particularly, to a screwdriver having a removable rod.

2. Description of the Related Art

U.S. Pat. No. 7,287,449 discloses a screwdriver with removable rod, which has set in the grip thereof latching balls (13) at a front side and blocking balls (14) at a rear side. The latching balls are engageable with corner cutouts of the rod to secure the rod in the received or extended position. The blocking balls can enter an annular neck of the rod, assuring the rod in the extended position and prohibiting it from being projected out of the grip. Further, the operating tube (referenced by 7) is inwardly pressable to control the rod from outward projection. This operation manner is inconvenient. The user may actuate the operating tube accidentally, causing the rod to be forced out of the grip. Accidentally projecting the rod out of the grip can scare the user, or cause injury.

Taiwan 201107093 discloses another design of screwdriver with removable rod. This design teaches a rotary control technique instead of press operation, avoiding an accidental actuation of the control member (referenced by 43) to force out the rod. Thus, the rod will spring out only after the user rotated the control member. Further, this design simply uses one set of positioning means (referenced by 41) to engage a front retaining portion (referenced by 32) or rear constraint portion (referenced by 33) of the rod, locking the rod in a received position or extended position. This design eliminates the drawbacks of U.S. Pat. No. 7,287,449, however, the use of one single set of positioning means for locking the rod in the received or extended position, the set of positioning means may be not positively forced into engagement with the constraint portion of the rod as the rod is being forced out of the grip of the screwdriver at a high speed, causing the rod to be ejected out of the screwdriver.

SUMMARY OF THE INVENTION

The present invention has been accomplished under the circumstances in view. It is the main object of the present invention to provide a screwdriver having a removable rod member, which adopts a rotary operating technique to control the operating member, effectively preventing ejection of the rod member out of the grip.

To achieve this and other objects of the present invention, a screwdriver comprises a grip, which comprises an accommodation chamber axially extending to a front side thereof; an inner tube, which is affixed to the grip in the accommodation chamber, comprising at least one interference hole located on the periphery near a front end thereof and an inner circumferential surface having a non-circular cross section; a rod member, which is axially movably inserted into the inner tube, comprising a tool bit connector located on a front end thereof and disposed outside the inner tube, a cross section corresponding to the cross section of the inner circumferential surface of the inner tube, at least one interference groove located on the periphery near thereof near the tool bit connector, a neck disposed near a rear end thereof and a latching member arranged at and protruding over the periphery thereof between the neck and the at least one interference groove; an operating device set, which comprises an operating member, an actuation member and at least one interference member, the operating member being arranged at the front end of the grip and rotatable relative to the grip by a user, the actuation member being accommodated in the accommodation chamber and drivable by the operating member to move between an actuated position and a normal position, the at least one interference member being disposed in the accommodation chamber and driven by the actuation member to partially project through the at least one interference hole into the space inside the inner tube, the actuation member comprising a pressure wall, which holds down the at least one interference member to partially project through the at least one interference hole into the space inside the inner tube when the actuation member is in the normal position, the pressure wall being kept away from the at least one interference member when the actuation member is in said actuated position, a first elastic member accommodated in the accommodation chamber and adapted to impart a pressure to the actuation member toward the normal position; a ring cap, which is capped on the front end of the inner tube, comprising an axial hole for the passing of the rod member and a stop wall radially disposed around the axial hole for stopping against the latching member; and a second elastic member mounted in a rear side inside the inner tube and adapted to impart a forward pressure to the rod member to push the rod member out of the inner tube. Thus, the screwdriver allows a user to operate the operating member by rotation and can effectively prevent the rod member from being ejected out of the grip.

Other advantages and features of the present invention will be fully understood by reference to the following specification in conjunction with the accompanying drawings, in which like reference signs denote like components of structure.

DETAILED DESCRIPTION OF THE INVENTION

Figure 1:
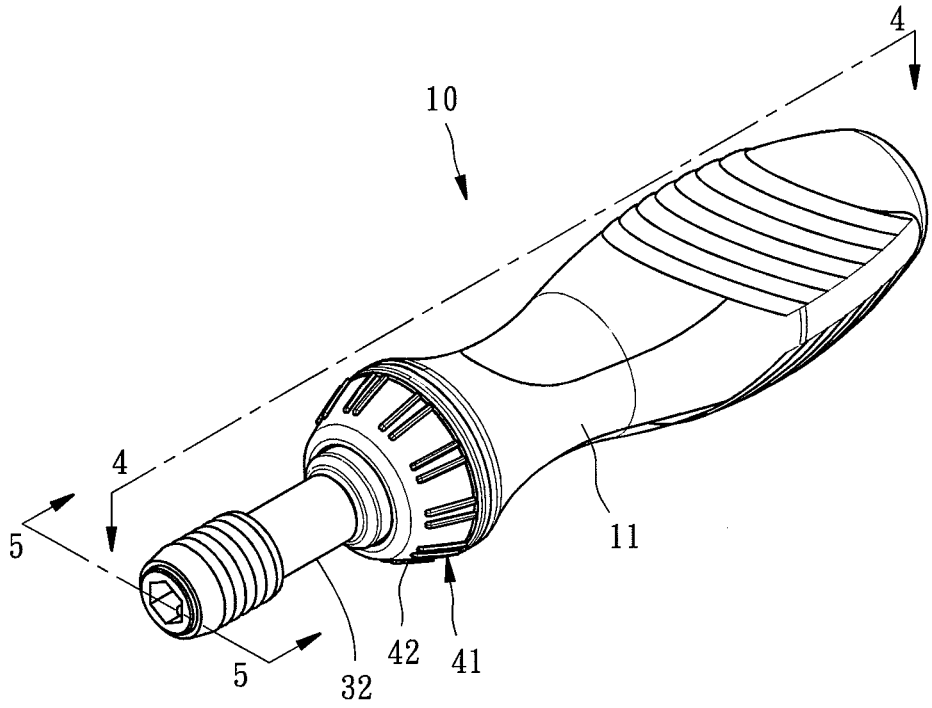
FIG. 1 is an elevational view of a screwdriver having a removable rod member in accordance with a first embodiment of the present invention.
Figure 2:
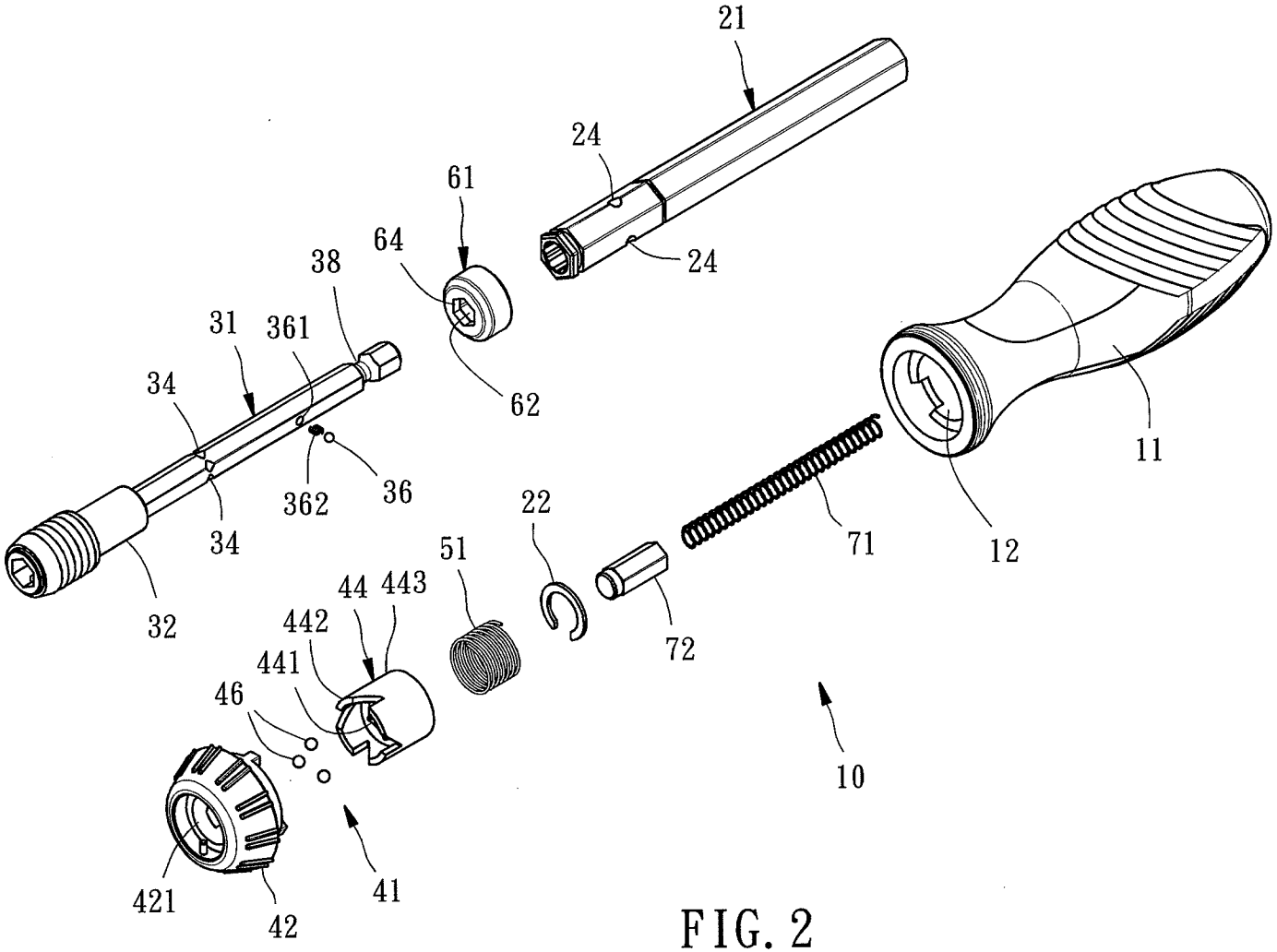
FIG. 2 is an exploded view of the screwdriver with removable rod in accordance with the first embodiment of the present invention.
Figure 3:
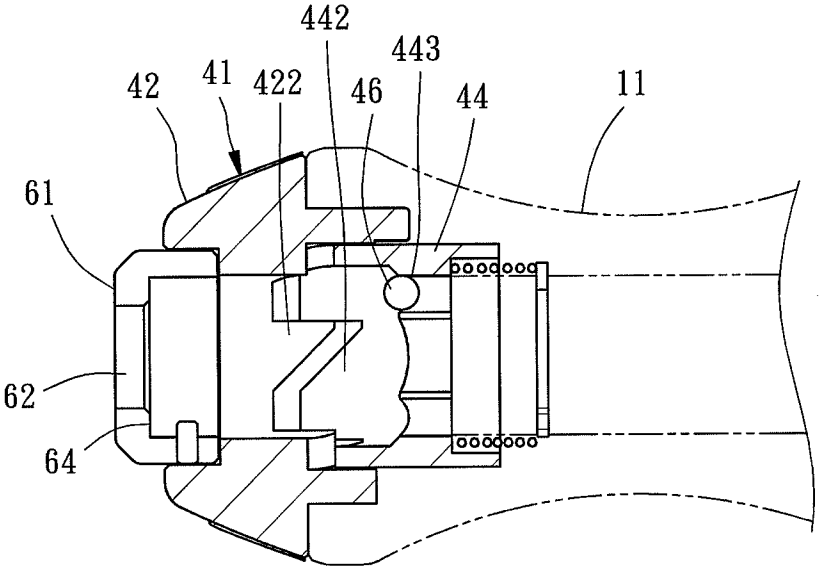
FIG. 3 is a schematic sectional view, in an enlarged scale, of a part of the first embodiment of the present invention, illustrating the operating member meshed with the actuation member.

Referring to FIGS. 1 through 4, a screwdriver 10 in accordance with a first embodiment of the present invention is shown comprising a grip 11, an inner tube 21, a rod member 31, an operating device set 41, a first elastic member 51, a ring cap 61 and a second elastic member 71.

The grip 11 defines therein an accommodation chamber 12 that extends axially to the front side of the grip 11. Further, the accommodation chamber 12 in this embodiment has a polygonal cross section.

The inner tube 21 is affixed to the grip 11 in the accommodation chamber 12, having at least one, for example, three interference holes 24 spaced around the periphery near the front end thereof. The internal circumferential surface of the inner tube 21 has a noncircular cross section, for example, polygonal cross section. The outer circumferential surface of the inner tube 21 has a polygonal cross section. Thus, after installation of the inner tube 21 in the accommodation chamber 12, the inner tube 21 is prohibited from rotation relative to the grip 11. Further, a C-shaped retaining ring 22 is fastened to the outside wall of the inner tube 21.

The rod member 31 has the front end thereof terminating in a tool bit connector 32, and a polygonal cross section fitting the cross section of the internal circumferential surface of the inner tube 21 to prohibit relative rotation between the rod member 31 and the inner tube 21. Further, the rear part of the rod member 31 is axially movably inserted into the inner tube 21. The rod member 31 further comprises at least one, for example, six interference grooves 34 located on the periphery. When the rod member 31 is moved relative to the inner tube 21 to a predetermined position, three of the six interference grooves 34 will be respectively aimed at the three interference holes 24 of the inner tube 21. Further, a latching member 36 is arranged at and protrudes over the periphery of the rod member 31 near a rear part of the rod member 31. According to this embodiment, the latching member 36 is a latching ball supported on a spring 362 in a recessed hole 361 at the periphery of the rod member 31 and partially protruding over the periphery of the rod member 31. Further, the latching member 36 is installed in one plane of the polygonal cross section of the rod member 31. Further, the rod member 31 has a neck 38 disposed near the rear end thereof further behind the latching member 36.

The operating device set 41 comprises an operating member 42, an actuation member 44, and at least one interference member 46. The operating member 42 is arranged at the front side of the grip 11 for operation by a user. In this embodiment, the operating member 42 comprises a round axial hole 421, which is attached onto the inner tube 21 for allowing the operating member 42 to be rotated relative to the inner tube 21 by a user, and a series of ratchet teeth 422 disposed around one end of the round axial hole 421. The actuation member 44 defines an axial hole 441 that has a polygonal cross section corresponding to the outer circumferential surface of the inner tube 21 to prohibit relative rotation between the actuation member 44 and the inner tube 21. The actuation member 44 is set in the accommodation chamber 12 and attached to the periphery of the inner tube 21. Further. The actuation member 44 comprises a series of ratchet teeth 442 corresponding to the series of ratchet teeth 422 of the operating member 42. The series of ratchet teeth 442 of the actuation member 44 is meshed with the series of ratchet teeth 422 of the operating member 42 so that the operating member 42 is operable to move the actuation member 44 between an actuated position and a normal position. This ratchet teeth engagement design can be referred to the prior art Taiwan 201107093. The at least one interference member 46 in this embodiment is three latching balls accommodated in the accommodation chamber 12 between the inner tube 21 and the actuation member 44, and can be forced to partially project through the three interference holes 24 into the space inside the inner tube 21 subject to the operation of the actuation member 44. The actuation member 44 comprises a pressure wall 443. When moved the actuation member 44 to the normal position, the pressure wall 443 holds down the three latching balls 46, forcing the latching balls 46 to partially project through the three interference holes 24 into the space inside the inner tube 21. When moved the actuation member 44 away from the normal position to the actuated position, the pressure wall 443 is kept away from the three latching balls 46, thereby releasing the latching balls 46.

The first elastic member 51 is set in the accommodation chamber 12 outside the inner tube 21, and adapted to provide a pressure to the actuation member 44 toward the normal position. In this embodiment, the first elastic member 51 is a coil spring sleeved onto the inner tube 21 and stopped between the C-shaped retaining ring 22 and the actuation member 44.

The ring cap 61 is capped on the front end of the inner tube 21, comprising an axial hole 62 for the passing of the rod member 31, a stop wall 64 radially disposed around the axial hole 62 and adapted for stopping the latching member 36. In this embodiment, the stop wall 64 has a polygonal shape corresponding to the cross section of the rod member 31. The distance between the latching member 36 and the neck 38 corresponds to the distance between the stop wall 64 and the three latching balls 46. Thus, when moved the rod member 31 to the position where the latching member 36 is stopped against the stop wall 64, the three latching balls 46 are forced into engagement with the neck 38 of the rod member 31.

The second elastic member 71 is a spring mounted in the rear side inside the inner tube 21 and adapted to impart a spring force to the rod member 31 to force the rod member 31 forwards. This first embodiment of the present invention further comprises an end cap 72 set in the inner tube 21 at the rear side of the rod member 31 and capped on one end of the second elastic member 71. The other end of the second elastic member 71 is stopped against the grip 11. By means of the end cap 72, the second elastic member 71 is stopped against the rod member 31. The end cap 72 is adapted to keep the second elastic member 71 in stoppage against the rear end of the rod member 31. However, the end cap 72 is not a requisite member. Without the end cap 72, the second elastic member 71 can still be effectively stopped against the rear end of the rod member 31.

After understanding of the structural details, the operation of the screwdriver will be outlined hereinafter.

Figure 4:
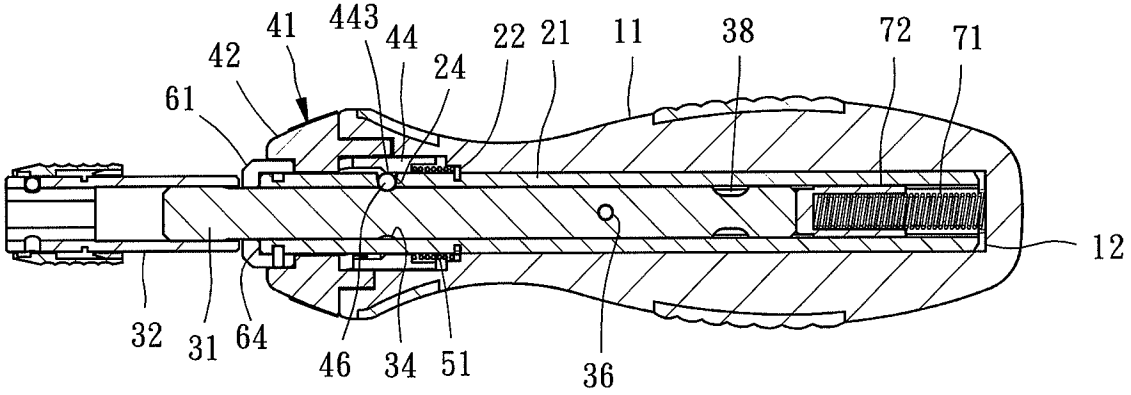
FIG. 4 is a sectional view taken along line 4-4 of FIG. 1.
Figure 5:
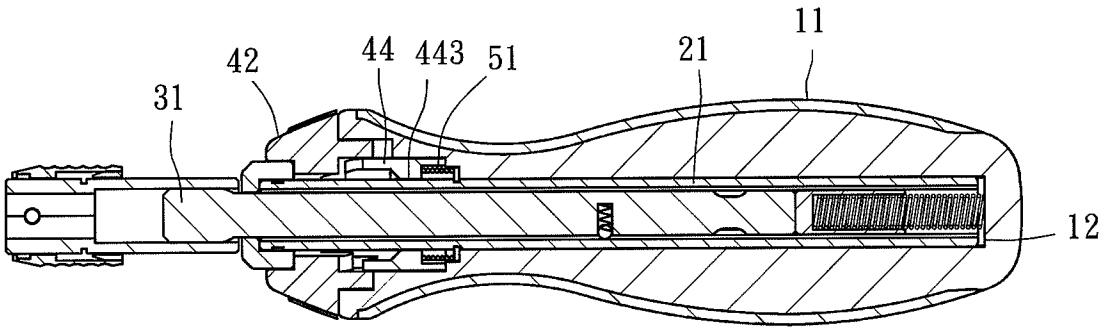
FIG. 5 is a sectional view taken along line 5-5 of FIG. 1.

As shown in FIGS. 4 and 5, when the operating member 42 is not operated, the rod member 31 is partially received in the accommodation chamber 12 of the grip 11. At this time, the operating member 44 is kept in the normal position; the pressure wall 443 of the actuation member 44 holds down the latching balls 46 in the three interference holes 24 of the inner tube 21 into engagement with the corresponding three interference grooves 34, thereby locking the rod member 31 in the currently received position.

Figure 6:
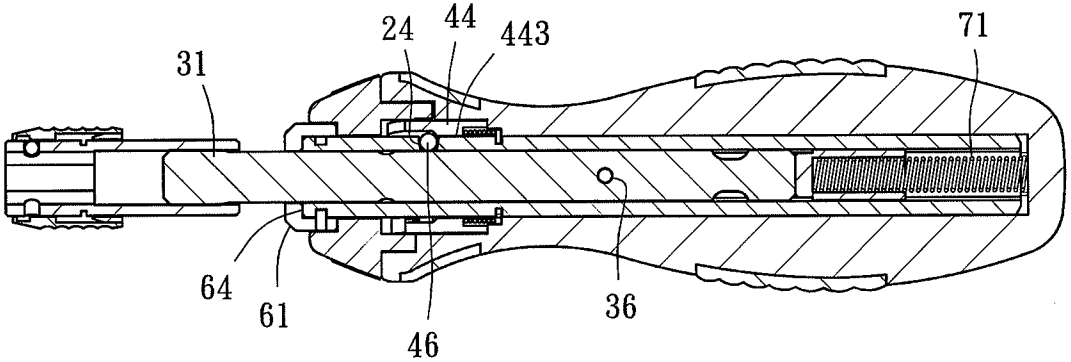
FIG. 6 is a schematic sectional view of the first embodiment of the present invention, illustrating a forward stroke of the rod member relative to the grip.
Figure 7:
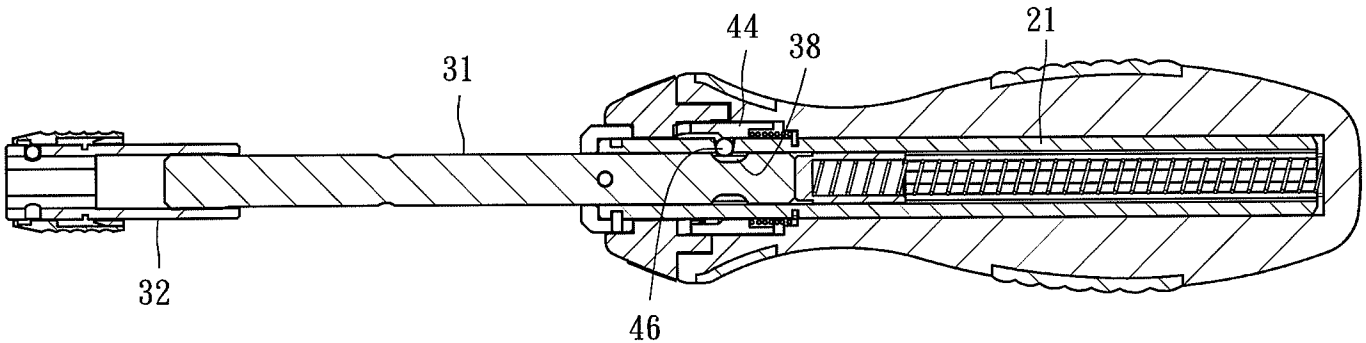
FIG. 7 corresponds to FIG. 4, illustrating the rod member moved to the extended position.
Figure 8:
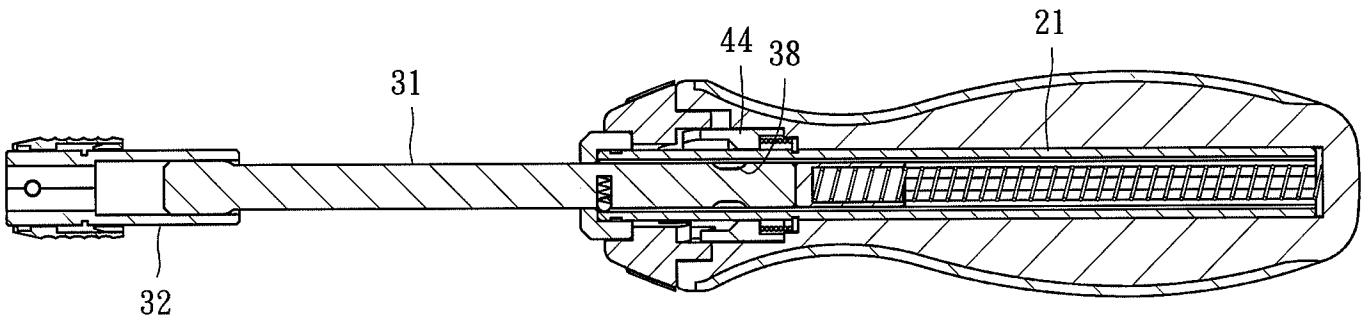
FIG. 8 corresponds to FIG. 5, illustrating the rod member moved to the extended position.

When going to use the rod member 31, rotate the operating member 42. At this time, subject to engagement between the operating member 42 and the actuation member 44, the actuation member 44 is moved by the operating member 42 from the normal position to the actuated position, and then forced by the first elastic member 51 to return to the normal position. As shown in FIG. 6, when the actuation member 44 is moved to the actuated position, the pressure wall 443 of the actuation member 44 is moved away from the latching balls 46, allowing free movement of the latching balls 46 in and out of the three interference holes 24. The thrust force being applied by the second elastic member 71 to the rod member 31 overcomes the interference pressure of the latching balls 46, thereby pushing the rod member 31 toward the outside of the inner tube 21 and the grip 11. When the rod member 31 reaches the position where the latching member 36 is stopped against the stop wall 64, the rod member 31 is prohibited from further forward displacement, and therefore, the rod member 31 will not be ejected out of the grip 11. Thereafter, as shown in FIGS. 7 and 8, the actuation member 44 is returned to the normal position, and the three latching balls 46 are forced into engagement with the neck 38 of the rod member 31 to lock the rod member 31 in the currently extended position for application. In actual application, a tool bit (for example, cross-head tip) can be attached to the tool bit connector 32, enabling the screwdriver to be used as a Phillips screwdriver. This application method is the known art, no further illustrations are to be provided.

When going to receive the rod member 31 inside the grip 11, rotate the operating member 42 again to release the three latching balls 46 from the constraint, and then push the rod member 31 back to the inside of the grip 11 and then release the operating member 42, and thus, the actuation member 44 is automatically returned to the normal position subject to the effect of the first elastic member 51. At this time, the three latching balls 46 are kept in engagement with the corresponding three interference grooves 34 to lock the rod member 31 in the received position.

Figure 9:
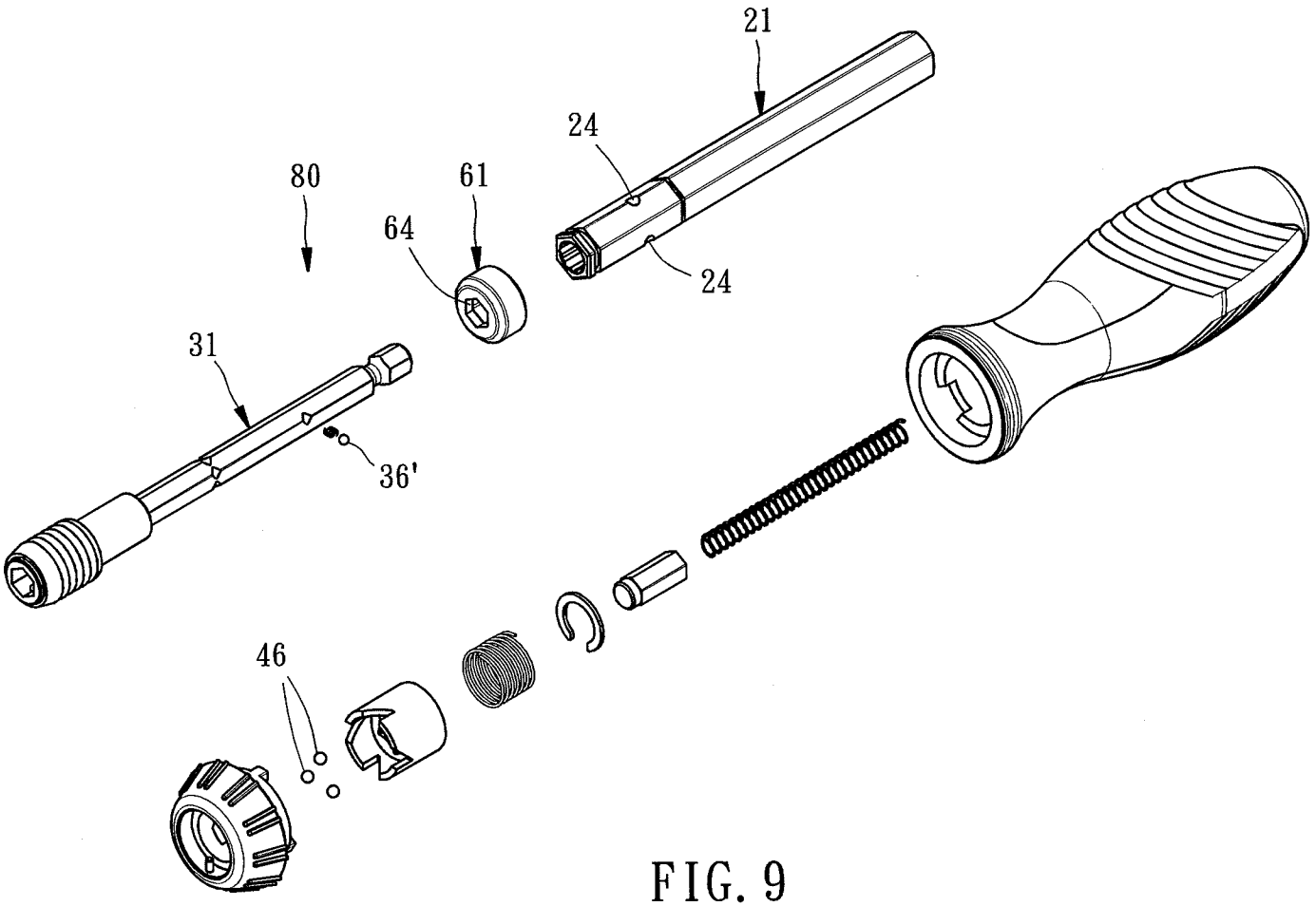
FIG. 9 is an exploded view of a screwdriver having a removable rod member in accordance with a second embodiment of the present invention.

FIG. 9 illustrates a screwdriver 80 in accordance with a second embodiment of the present invention. This second embodiment is substantially similar to the aforesaid first embodiment with the exception of the following features:

The internal circumferential surface of the inner tube 21 and the rod member 31 both have a hexagonal cross section. The latching member 36' is arranged at one angle of the hexagonal outside wall of the rod member 31, which is not corresponding to any of the three interference holes 24 of the inner tube 21.

Thus, the latching member 36' can be stopped by the stop wall 64 of the ring cap 61 to achieve the same effects as the aforesaid first embodiment. Further, as the latching member 36' is not corresponding to any of the three interference holes 24 of the inner tube 21, the latching member 36' does not interfere with the outward displacement of the rod member 31 or stop the rod member 31 from outward displacement.

The other structural details and functioning of this second embodiment are same as the aforesaid first embodiment, and therefore, no further detailed description in this regard is necessary.

In conclusion, the invention provides a screwdriver having a removable rod member, which adopts a rotary operating technique to control the operating member, effectively preventing ejection of the rod member out of the grip.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A screwdriver, comprising:

a grip comprising an accommodation chamber axially extending to a front side thereof;

an inner tube affixed to said grip in said accommodation chamber, said inner tube comprising at least one interference hole located on the periphery near a front end thereof and an inner circumferential surface having a non-circular cross section;

a rod member axially movably inserted into said inner tube, said rod member comprising a tool bit connector located on a front end thereof and disposed outside said inner tube, a cross section corresponding to the cross section of the inner circumferential surface of said inner tube, at least one interference groove located on the periphery near thereof near said tool bit connector, a neck disposed near a rear end thereof and a latching member arranged at and protruding over the periphery thereof between said neck and said at least one interference groove;

an operating device set comprising an operating member, an actuation member and at least one interference member, said operating member being arranged at the front end of said grip and rotatable relative to said grip by a user, said actuation member being accommodated in said accommodation chamber and drivable by said operating member to move between an actuated position and a normal position, said at least one interference member being disposed in said accommodation chamber and driven by said actuation member to partially project through said at least one interference hole into the space inside said inner tube, said actuation member comprising a pressure wall, said pressure wall holding down said at least one interference member to partially project through said at least one interference hole into the space inside said inner tube when said actuation member is in said normal position, said pressure wall being kept away from said at least one interference member when said actuation member is in said actuated position;

a first elastic member accommodated in said accommodation chamber and adapted to impart a pressure to said actuation member toward said normal position;

a ring cap capped on the front end of said inner tube, said ring cap comprising an axial hole for the passing of said rod member and a stop wall radially disposed around the axial hole for stopping against said latching member; and a second elastic member mounted in a rear side inside said inner tube and adapted to impart a forward pressure to said rod member to push said rod member out of said inner tube.

2. The screwdriver as claimed in claim 1, wherein said inner tube has a polygonal outer circumferential surface and a polygonal inner circumferential surface; said actuation member comprises a polygonal axial hole fitting the polygonal outer circumferential surface of said inner tube; said rod member has a polygonal cross section fitting the polygonal inner circumferential surface of said inner tube.

3. The screwdriver as claimed in claim 2, wherein said inner tube comprises three interference holes respectively located on one respective angle of the polygonal outer circumferential surface thereof; said rod member comprises six interference grooves respectively located on one respective angle of the polygonal cross section thereof; said at least one interference member comprises three latching balls.

4. The screwdriver as claimed in claim 3, wherein the stop wall of said ring cap has a polygonal shape fitting the cross section of said rod member.

5. The screwdriver as claimed in claim 2, wherein said latching member is arranged at one angle of the polygonal cross section of said rod member beyond the angles of the polygonal cross section of said rod member that correspond to said three interference holes.

6. The screwdriver as claimed in claim 2, wherein said latching member is arranged at one plane of the polygonal cross section of said rod member.

7. The screwdriver as claimed in claim 6, wherein said rod member further comprises a recessed hole, and a spring mounted in said recessed hole to support said latching member and to impart an outward pressure to said latching member, forcing said latching member to protrude over the periphery of said rod member.

8. The screwdriver as claimed in claim 2, wherein said operating member comprises a round axial hole sleeved onto said inner tube and rotatable relative to said inner tube by a user, and a series of ratchet teeth arranged around said round axial hole; the polygonal axial hole of said actuation member fits the polygonal outer circumferential surface of said inner tube to prohibit said actuation member from rotation relative to said inner tube; said actuation member comprises a series of ratchet teeth meshed with the series of ratchet teeth of said operating member.

9. The screwdriver as claimed in claim 1, wherein said inner tube further comprises a C-shaped retaining ring fastened to the periphery thereof; said first elastic member is a coil spring sleeved onto said inner tube and stopped between said C-shaped retaining ring and said actuation member.

10. The screwdriver as claimed in claim 1, wherein the distance between said latching member and said neck of said rod member corresponds to the distance between said stop wall of said ring cap and said at least one interference member.

11. The screwdriver as claimed in claim 1, further comprising an end cap capped on one end of said second elastic member inside said inner tube and stopped against the rear end of said rod member, wherein said second elastic member has one end thereof received in said end cap and stopped against the rear end of said rod member and an opposite end thereof stopped against said grip.

* * * * *